United States Patent [19]

Takahashi

[11] Patent Number: 4,577,574

[45] Date of Patent: Mar. 25, 1986

[54] ELECTRONIC SEWING MACHINE WITH A PATTERN DISPLAY

[75] Inventor: Yoshitaka Takahashi, Kanagawa, Japan

[73] Assignee: Janome Sewing Machine Co., Ltd., Tokyo, Japan

[21] Appl. No.: 594,774

[22] Filed: Mar. 26, 1984

[30] Foreign Application Priority Data

Mar. 28, 1983 [JP] Japan ..... 58-50520

[51] Int. Cl.[4] ..... D05B 3/02; D05B 35/12

[52] U.S. Cl. ..... 112/445; 112/453

[58] Field of Search ..... 112/158 E, 158 F, 121.11, 112/121.12, 444, 445, 453, 454; 364/470

[56] References Cited

U.S. PATENT DOCUMENTS 4,280,423 7/1981 Goncharko ..... 112/158 F X 4,341,170 7/1982 Beckerman et al. ..... 112/158 E 4,429,364 1/1984 Maruyama et al. ..... 112/158 E

*Primary Examiner*—Peter Nerbun

*Attorney, Agent, or Firm*—Michael J. Striker

[57] ABSTRACT

An electronic sewing machine with a dot matrix display for representing the image of a selected pattern to be stitched, having a first memory which stores stitch control data which may be sequentially read out in dependence upon a selected pattern per rotation of the sewing machine and transmitted to a driving part of a stitch forming mechanism; prior to initiation of the driving part, a calculator receives the read out stitch control data to make calculations for linearly interpolating between the adjacent stitches, thus to repeatedly renew the stitch control data into display data; a second memory stores the display condition data for controlling the cycle of pattern unit to be displayed; a counter counts up the cycles of the selected pattern in reference to the renewed stitch control data. Thus when the display calculations are finished through out the pattern cycles, the sewing operation is made possible, and the calculated display data are temporarily stored in a third memory to drive the dot matrix display of the sewing machine.

7 Claims, 6 Drawing Figures

FIG_3
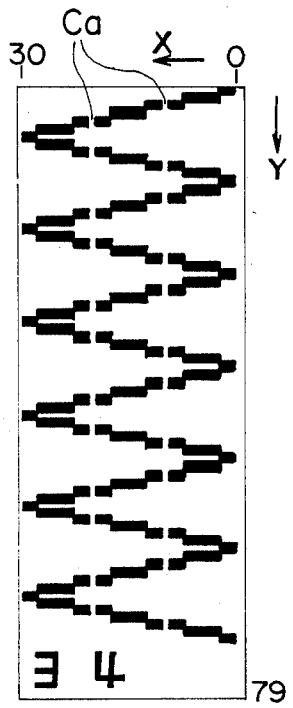
FIG_2
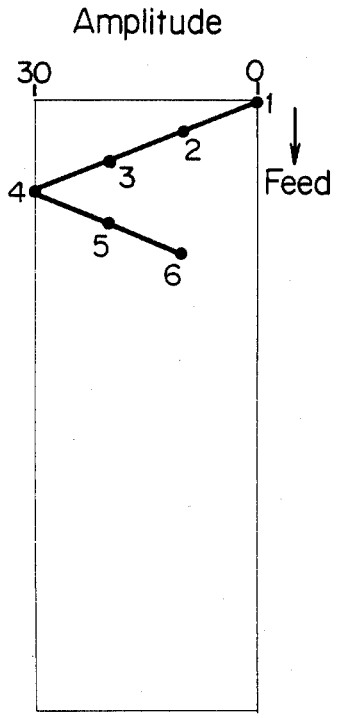
FIG_5
| Stitches | Amplitude | Feed |
|---|---|---|
| 1 | 0 | 4 |
| 2 | 10 | 4 |
| 3 | 20 | 4 |
| 4 | 30 | 4 |
| 5 | 20 | 4 |
| 6 | 10 | 4 |
FIG_6
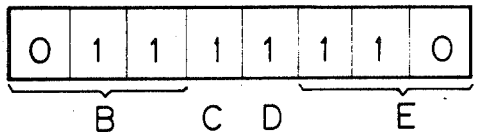

ELECTRONIC SEWING MACHINE WITH A PATTERN DISPLAY

FIELD OF THE INVENTION

The invention relates to an electronic sewing machine having a number of stitch control data electronically stored in a memory which may be sequentially read out to produce stitch patterns, and more particularly relates to a pattern display of the sewing machine which may be operated at the time of pattern selection to represent thereat the image of the selected pattern or a selected sewing item.

BACKGROUND OF THE INVENTION

It is well known that this type of sewing machine may produce a number of stitch patterns. Generally the patterns to be stitched are all printed on the sewing machine panel, and are selectively illuminated when any of the patterns are selected by operation of a corresponding pattern selecting switch or by use of ten-key. In this respect, since so many patterns are printed in a generally limited and narrow space of the sewing machine, it is inevitably required to make the size of each pattern quite small to the extend that it is often difficult to find a desired one. Otherwise it may be considered that the patterns to be stitched are each selectively represented by way of a number which is specific to a selected pattern by operation of a ten-key system, which pattern number being referred to a separate pattern table to confirm the identity. Such a way of pattern slection is however troublesome and time consuming.

SUMMARY OF THE INVENTION

It is therefore a primary object of present invention to provide an electronic sewing machine having a dot matrix display for representing a selected stitch pattern to be produced each time a different pattern selecting switch is operated. For attaining this object, a first memory stores stitch control data which may be sequentially read out in dependence upon a selected pattern per rotation of the sewing machine and transmitted to a driving part of a stitch forming mechanism; prior to initiation of the driving part, a calculator receives the read out stitch control data to make calculations for linearly interpolating between the adjacent stitches, thus to repeatedly renew the stitch control data into display data; a second memory stores the display condition data for controlling the cycle of pattern unit to be displayed; a counter counts up the cycles of the selected pattern in reference to the renewed stitch control data. Thus when the display calculations are finished through out the pattern cycles, the sewing operation is made possible, and the calculated display data are temporarily stored in a third memory to drive the dot matrix display of the sewing machine.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS:

FIG. 2 is an example of a stitch pattern, FIG. 3 is a displayed example of the stitch pattern according to the invention, FIG. 5 is a table showing the needle amplitude coordinates and fabric feeding amount coordinates each in pairs, and FIG. 6 is a table showing display condition designating signals.

DETAILED DESCRIPTION OF THE PREFERRED EMBODIMENTS

Figure 1:
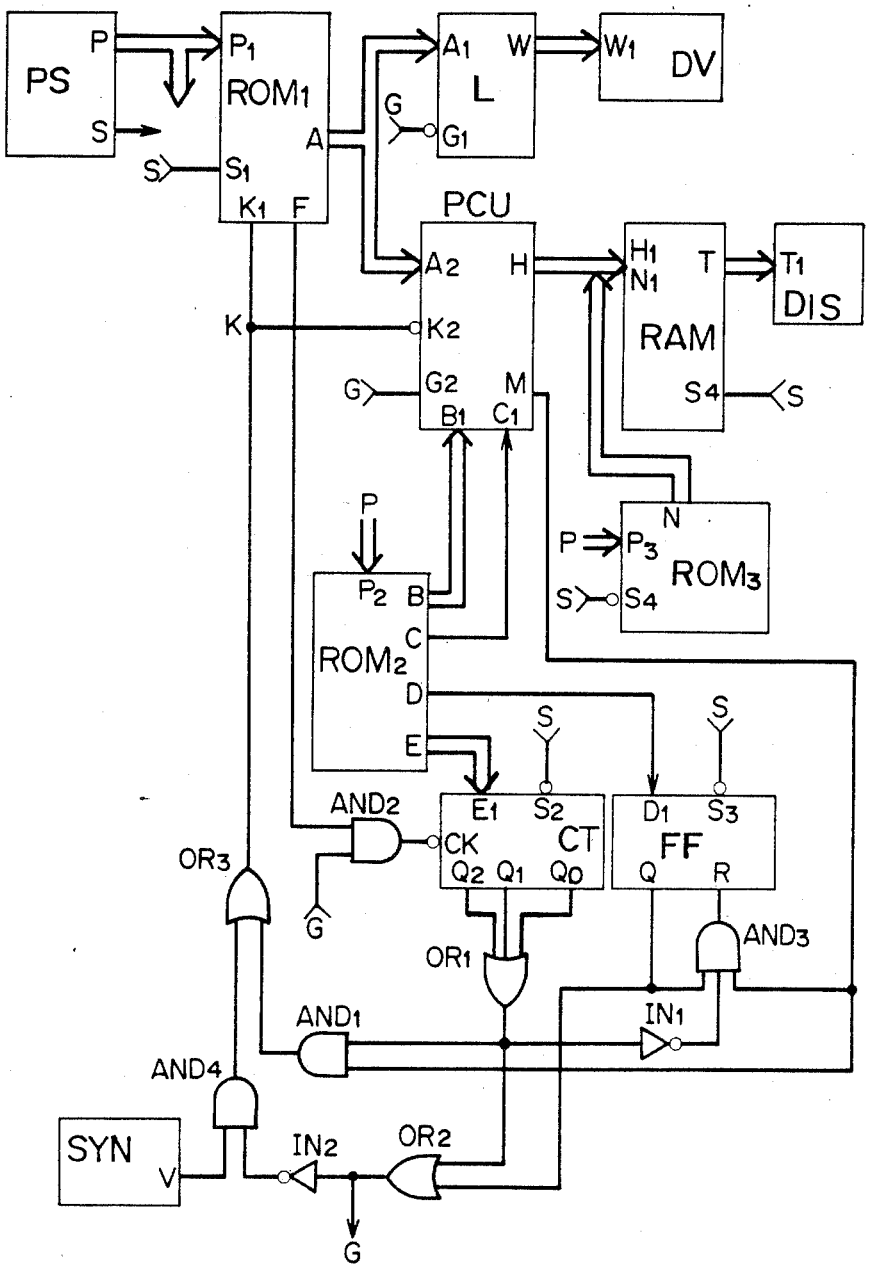
FIG. 1 is a block diagram of a control circuit showing an embodiment of the invention.

The invention will be explained in reference to an embodiment shown in the attached drawings. In FIG. 1, a pattern selecting device (PS) has operating switches (not shown) provided on a panel (not shown) of a sewing machine. When one of the operating switches is operated, the device (PS) gives at a terminal (P) a pattern signal P which is specific to this pattern from a terminal (P), and then gives at another terminal S a pulse signal S (called as "selection signal" hereinafter) indicating said operation that the operating switch has been operated (in the following description, output or input terminals corresponding to the same signal will be indicated with the same mark as a mark showing said signal for the same mark with suffix, and an explanation will be made with either one). A first memory (ROM1) electronically stores stitch control signals of a plurality of stitch patterns with the addresses thereof. When the first memory (ROM1) receives the pattern signal P and the selection signal S, the memory (ROMI) gives an initial stitch control signal A of said pattern at the standing flank of the signal S, which is applied to a latch (L) and a calculator (PCU). Subsequently, the address is advanced per standing flank of stitch renewing signal K, and the stitch control signal A is renewed, and a cycle finishing signal is produced from a terminal (F) after the last stitch control signal of said pattern has been issued. With respect to the stitch control signal A for, e.g., three-point zigzag stitches as shown in FIG. 2, in back of the addresses of the memory (ROMI) are stored pairs of needle amplitude coordinates and fabric amount coordinates, wherein the needle amplitude coordinate consists of 0 to 30 for stitch numbers to be renewed successively, each in pairs with a constant fabric feed amount 4 in the forward feed direction in this case. In order to enable a display (DIS) of dot matrix type to represent an illustration as shown in FIG. 3 for the stitch pattern of FIG. 2, a second memory (ROM2) stores the signals which may be used to determine the number of the illustrated stitch cycles and to modify the illustration in reduction or enlargement. Namely, in response to the pattern signal P, for example, the stitch pattern shown in FIG. 2, the memory (ROM2) stores a feed coefficient B for designating reduction or enlargement of the displayed illustration in the fabric feeding direction as shown in FIG. 6; a needle drop display signal C for designating a needle drop indication (Ca) shown by the interruptions in FIG. 3; the last indication signal D for designating whether or not illustrating the initial stitch following the last stitch; and a cycle signal E for designating which number of stitch cycles are illustrated. FIG. 6 is a table where the signals B, C, D, E are 3, 1, 1, 6 respectively in the decimal system, and for designating the display conditions in FIG. 3.

A counter (CT) receives the cycle designating signal E of the second memory (ROM2) and sets the signal E at the standing flank of the selection signal S, and continues to give the bit signals thereof to output terminals ($Q_2$), ($Q_1$), ($Q_0$) while subtracting the bit signals each time it receives the falling flank of a later mentioned signal at a clock terminal (CK), and maintains a signal G as a logic value 1, via OR circuits ($OR_1$), ($OR_2$) until the result of the subtraction becomes 0. The signal G designates whether or not a display calculation is being made.

When the selection operating signal S is issued, a calculator (PCU) receives the signal G and starts operation, and receives the stitch control signal A from the first memory (ROM1) per falling flank of the stitch renewing signal K in accordance with a later mentioned program to make calculations for interpolation by lines (straight lines in this case) between the stitch coordinates of the adjacent stitch control signals A, to thereby render the result thereof a display data H and then gives the data to a display data memory (RAM). The feed coefficient signal B and the needle drop display signal C from the second memory (ROM2) may be added to said calculations. PCU issues a calculation finishing signal M each time a required calculation is finished, to thereby produce the stitch renewing signal K via AND circuit (AND1) and OR circuit (OR3) for a period while the counter (CT) is not 0, and thus advances the calculation as renewing the stitches. During this period, the counter (CT) makes a subtraction via AND circuit (AND2) each time the cycle finishing signal F is issued from the first memory (ROM1). The calculator (PCU) is reflected with the cycle designating signal E of the second memory (ROM2). The flipflop circuit (FF) receives, as later mentioned, the last indication signal D from the second memory (ROM2). When the signal D is designating 1 (the needle drop indication (Ca) is designated as shown in FIG. 3) and after D flipflop circuit (FF) receives the selection signal S, the flipflop makes the output Q to be 1. Subsequently, when the first memory (ROM1) gives the initial stitch control signal A with the falling flank of the cycle finishing signal F in the last display cycle and the outputs $Q_A$, $Q_B$, $Q_C$ of the counter (CT) are rendered 0, then the AND circuit (AND3) receives 0 via an inverter (IN1), and then gives a calculation finishing signal M of the calculator (PCU) to a reset terminal (R) of the flipflop circuit (FF). Thus, the calculator (PCU) is reflected with the last display designation signal from the second memory (ROM2) in order to maintain the signal G until the calculation from finish of the cycle to an initial stitch is finished.

A third memory (ROM3) stores pattern numbers (for example, the number 34 in FIG. 3) and the information display data each for a selected pattern, and receives the signals P and S from the pattern selecting device (PS) and gives information display data N for the selected pattern.

A display data memory (RAM) is reset by the selection signal S, and receives and temporally stores the display data H and N from the calculator (PCU) and the third memory (ROM3), and continues to give a display scanning data T to a dot matrix display (DIS).

The display (DIS) of the dot matrix type is a liquid crystal indicator of lateral 31 dots and vertical 80 dots as shown in FIG. 3. Since the interpolation value calculated in the calculator (PCU) is shown by counting as one fractions of more than 0.5 inclusive and cutting away the rest in regard to fractions below the resolution by the dot, the stitches as seen in FIG. 2 may be displayed in a stepped condition as shown in FIG. 3.

A latch is an inhibit circuit which maintains the stitch control signal A (this is an initial stitch control signal) issued from the first memory (ROM1) by the standing flank of the display calculation signal G and gives a stitch control signal W to a driving part (DV), and maintains the signal W unchanged until the signal G becomes C during the display calculation even if the stitch control signal A changes. If the stitch control signal A of the first memory (ROM1) is renewed during the display calculation the drive part (DV) is prevented from responding to the signal. When the signal G becomes 0 during the display calculation to start the stitch, the latch circuit (L) gives the signal W as the signal A changes. The drive part (DV) is to drive a stitch forming mechanism (not shown) of the sewing machine, and comprises control motors, drive circuits and other relating parts. A generator (SYN) is operated in synchronism with the an upper shaft of the sewing machine to produce a pulse signal V in response to a determined needle phase per rotation of the upper shaft.

Under condition that the signal G is 0 during the calculation of the indication, AND circuit (AND4) receives the signal 0 via an inverter (IN2) to make the signal V of the generator (SYN) operative, and gives the stitch renewing signal K via OR circuit (OR3).

An explanation will be made regarding the calculating operation of the calculator (CPU) with respect to the display operaton of the above mentioned structure. In reference to the flow chart in FIG. 4, when a power source is supplied, a program control of the calculator (PCU) starts. Herein, assume that the three-point zigzag stitch shown in FIG. 2 is selected by the pattern selecting device (PS). The stitch control signals A in the first memory (ROM1) are as shown in FIG. 5, and the signals B to E of the second memory (ROM2) are as shown in FIG. 6. When the counter (CT) receives the selection signal S, it renders the output bits Q2 Q1 Q0 into 1 1 0, and makes the display calculation signal G into 1. At the same time, the output Q of the flipflop circuit (FF) is rendered 1. The calculator (PCU) renders the values of feed accumulation registers $Y_T$ and $Y_\theta$ into 0, respectively as initial values concerning the indicated fabric feed in order to carry out the interpolation calculation. Then the PCU receives the feed coefficient B=3 and calculates the reduction rate $Ky=(B+1)/2$. Ky=2 is obtained. This means that the fabric feed amount in FIG. 2 is illustrated by ½ reduction as shown in FIG. 3. The present data registers $X_N$ and $Y_N$ receive the stitch control signals A for controlling the needle amplitude and the feed amount for the initial stitch, and therefore the needle amplitude $X_N=C$ and the fabric feed $Y_N=4$. By adding the previous feed accumulation value $Y_T=0$ and the previous feed data value $Y_\theta=0$, a new feed accumulation value $Y_T=0$ is obtained. Then the present data $X_N=0$ and $Y_N=4$ of the needle amplitude and the fabric feed are entered into the previous data registers $X_\theta$ and $Y_\theta$ for a next calculation. A first needle is then amplitude 0 as shown with the mark 1 in FIG. 2, and the fabric feed at this time is not performed. When the needle position display signal C=1, the needle position is represented by a blank or interruption as shown in FIG. 3, and the calculation finishing signal M=1 is issued without the display data H being issued to the display data memory (RAM). Then the display calculation signal G=1, and accordingly the calculation finishing signal M=1. Therefore the stitch renewing signal K=1, and the calculation finishing signal M=0 is issued. Then the stitch renewing signal K=0 is provided, and the stitch is renewed. With the present data of the second stitch being applied, the registers $X_N=10$ and $Y_N=4$. The next step is to seek the variation Z of the needle amplitude for the feed amount per unit. This is to judge the obliqueness of the stitch as shown in FIG. 3 in dependence on the plus or minces of the variation Z, to thereby determine the progressing direction of the present stitch coordinate with respect to the previous coordinate, otherwise to determine the reference of progressing amount which is to be based on the amplitude or the feed amount so as to divide the adjacent stitches in the interpolating calculation which is made in dependence upon the variation |Z| which may be larger or smaller than 1. With respect to the latter, if |Z|>1 as shown in FIG. 3, for example, the variation is less than ±45° with respect to the lateral axis (X), and then the calculation is made by progressing dots one by one with respect to X. Therefore, since the variation at this time is less than 1 dot with respect to the vertical axis (Y), the calculation is never made rough. In the embodiment, the variation Z=5, and the accumulation value of the step count register (b) is Bd=1 for the progressing count in the interpolating calculation. Then, the register b=0, and the register b=1 by bfb+Bd. Since the conditions are $|<|Z|$ and $|b|<|X_N-X_\theta|=10$, $X=b+X_\theta$ is calculated for making the interpolating calculation between the stitches 1 and 2, and X=1 is obtained, and the result is $Y=(Y_\theta\times b)/\{Ky(X_N-X_\theta)\}+Y_T/K_Y=1/5$. The amplitude data X=1 and the feed data Y=1/5 are given to the display data memory (RAM) as the display data H. With respect to the feed data Y=1/5, the dot matrix type display (DIS) counts as one fractions of more than 0.5 inclusive and cuts away the rest, and evaluates it as 0. The program is repeatedly performed, and when b=2 is provided, X=2 and Y=2/5 are similarly obtained, and when b=3 is provided, X=3 and Y=3/5 are obtained. With respect to the value of Y, the dot matrix type display (DIS) evaluates it as 1. Thus, the displayed illustration as shown in FIG. 3 may be obtained. When b=10 is provided, $|b|=|X_N-X_\theta|$ is obtained and the program returns to Å1 . Since $Y_T=Y_T+Y_\theta=X_N=10$ and $Y_\theta=Y_N=4$ are then provided and the needle drop illustrating indication is C=1, the needle position (Ca) in FIG. 3 is obtained without the display data H being issued. Similarly as mentioned, the stitch is renewed, and the registers $X_N=20$ and $Y_N=4$ are provided as the present data. Since Z=5 and $|X_N-X_\theta|=10$ are provided, the same calculation as said is also repeatedly operated between the stitches 2 and 3. When the calculation between the stitches 3 and 4 is finished and the program returns to 1 as mentioned above, $Y_T=Y_T+Y_\theta=12$, $X_\theta=X_N=30$ and $Y_N=4$ are provided, and the stitch is renewed after the display of the needle drop, position is made and the registers $X_N=20$ and $Y_N=4$ are obtained as the present data. Since Z=−5 is then provided, Bd=−1 and $b=b+Bd=-1$ are obtained, and $X=b+X_\theta=29$, and $(Y=(Y_\theta\times b)/\{Ky(X_N-X_\theta)\}+Y_T/K_y=1/5+6$ are issued as the display data H. When the calculation until the 6th stitch is finished and the program returns to Å1 , $Y_T=Y_T+Y_\theta=20$, $X_\theta=X_N=10$ and $Y_\theta=Y_N=4$ are obtained, and when the calculation finishing signal M=1 after the needle position is displayed, the cycle finishing signal F is 1 and the counter (CT) is subtracted by 1. When the calculation is repeated and the calculation finishing signal M is issued 6 times, the counter (CT) is rendered 0. At this time the output of the flipflop circuit (FF) is 1 and the display calculation signal G=1. The program advances and the stitch renewing signal K=0, and the initial stitch data $X_N=0$ and $Y_N=4$ are obtained as the present data. When the program returns to Å1 and the calculation finishing signal M becomes 1, the output Q of the flipflop circuit (FF) is rendered 0 and the display calculation signal G=0 and the program returns to the start and waits until the signal G=1. When the signal G=0, the latch (L) transmits to the drive part (DV) the stitch control signal A of the first memory (ROM1) which is read out per each rotation of the sewing machine, and the sewing machine goes to the stitching operation.

Figure 4:
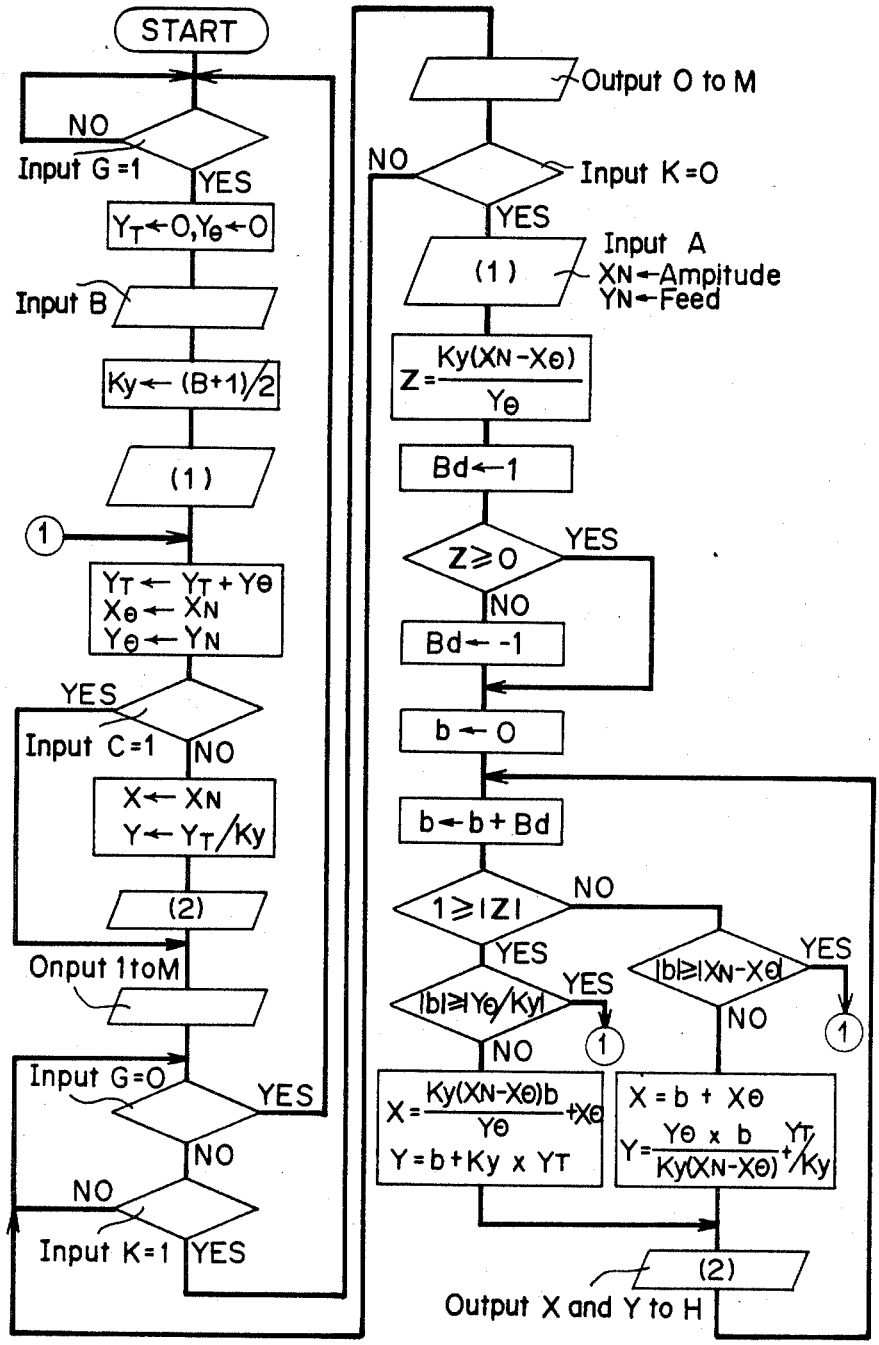
FIG. 4 is a flow chart showing the operation of the control circuit of FIG. 1.

In the flow chart shown in FIG. 4, when the needle position display designating signal C=0 is provided, the amplitude data X as the display data H is the present data $X_N$, and the feed data Y is the accumulation data $Y_T/K_y$ having been accumulated up to the present. The X and Y calculation formulas in response to $|\geqq H|$ are applied only when the obliquity by the stitching variation is more than ±45°.

As mentioned above, according to the invention, each time a pattern is selected, the pattern is shown on the display of the dot matrix type, and is clearly recognized. The display is brought about by utilizing the stitch control signals, so that the memory means is simplified.

While the invention has been illustrated and described as embodied in an electronic sewing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claim.

1. An electronic sewing machine with a dot matrix display for representing the image of a selected pattern to be stitched, the selected pattern consisting of a plurality of cycles, the sewing machine comprising:

(a) pattern selecting means selectively operated to produce a pattern signal (P) and an activating pulse signal (S);

(b) first memory (ROM 1) for storing stitch control data and sequentially reading out said data per rotation of the sewing machine in dependence upon the selected pattern, said first memory being responsive to said activating pulse signal and said pattern signal to produce an initial stitch control data (A1) of said selected pattern;

(c) drive means which receives said stitch control data from said first memory means and drives the sewing machine according to said stitch control data;

(d) second memory means (ROM 2) for storing display condition data including data (E) defining a set number of cycles to be displayed of the selected pattern, said second memory means being responsive to said pattern signal (P) to produce said data (E) defining the set number of cycles;

(e) counting means being reset in response to said activating pulse signal (S) from said pattern selecting means to latch said data defining the set number of cycles and simultaneously produce a start signal (G);

(f) calculator means (CPU) being responsive to said start signal to latch said initial stitch control data of said selected pattern from said first memory means and simultaneously produce a data renewing signal (K);

said first memory means being responsive to said data renewing signal to produce the next stitch control data and simultaneously a cycle renewing signal (F), said counting means being responsive to said cycle renewing signal to start counting said number of cycles, said calculator means receiving said next stitch control data from said first memory means to make a calculation with said initial stitch control data and said next stitch control data to thereby produce a display data and simultaneously produce said data renewing signal, said operations being continued in series until said set number of cycles is reached by the counting of said counting means while said calculator means is operated to repeatedly produce said display data of the selected pattern; and (g) display means which receives said display data from said calculator means, temporarily stores said display data and displays it on the dot matrix display.

2. Electronic sewing machine as defined in claim 1, further comprising means provided between said first memory means and said drive means and being responsive to said start signal (G) from said counting means to latch said initial stitch control data from said first memory means, said means maintaining said initial stitch control data while said first memory means is operated to successively produce the stitch control data of said selected pattern.

3. Electronic sewing machine as defined in claim 1, wherein said second memory is formed to store coefficient data for reducing or enlarging said selected pattern to be displayed, said calculator means receiving said coefficient data from said second memory means to modify each of said display data with said coefficient data to thereby reduce or enlarge said selected pattern to be displayed.

4. Electronic sewing machine as defined in claim 1, further comprising fourth memory means (ROM3) for storing data representing numbers for said selected pattern to be displayed, said number representing data being temporarily stored in said third memory together with said display data produced by said calculator means.

5. Electronic sewing machine as defined in claim 1, wherein said calculator means is arranged so as to renew said stitch control data into display data by linearly interpolating between adjacent stitches of the stitch pattern.

6. Electronic sewing machine as defined in claim 1, wherein said display means includes third memory means (RAM) which is reset each time a pattern is selected, temporarily storing said display data.

7. Electronic sewing machine as defined in claim 1, wherein said first memory means is formed so as to sequentially read out said stitch control data and produce said cycle renewing signal (F) each time it receives said data renewing signal (K) from said calculator means.

* * * * *